US010024088B1

(12) United States Patent
Dubina et al.

(10) Patent No.: US 10,024,088 B1
(45) Date of Patent: Jul. 17, 2018

(54) ARTICULATING HINGE FOR A REFRIGERATOR

(71) Applicant: Electrolux Home Products, Inc., Charlotte, NC (US)

(72) Inventors: Paul Dubina, Anderson, SC (US); Kunal Aggarwal, Clemson, SC (US)

(73) Assignee: Electrolux Home Products, Inc., Charlotte, NC (US)

( * ) Notice: Subject to any disclaimer, the term of this patent is extended or adjusted under 35 U.S.C. 154(b) by 0 days.

(21) Appl. No.: 15/836,072

(22) Filed: Dec. 8, 2017

(51) Int. Cl.
*F25D 23/02* (2006.01)
*E05D 3/12* (2006.01)
*E05D 3/02* (2006.01)

(52) U.S. Cl.
CPC ..... *E05D 3/122* (2013.01); *E05D 3/022* (2013.01); *F25D 23/028* (2013.01); *E05Y 2900/31* (2013.01); *F25D 2323/024* (2013.01); *Y10T 16/541* (2015.01); *Y10T 16/544* (2015.01); *Y10T 16/545* (2015.01)

(58) Field of Classification Search
CPC ..... E05D 3/122; E05D 3/125; E05D 3/127; E05D 3/022; E05D 7/0027; E05D 3/06; F25D 23/028; F25D 2323/024; F25D 23/02; E05Y 2900/31; E05Y 2201/71; E05Y 2201/716; E05Y 2201/72; Y10T 16/541; Y10T 16/5457; Y10T 16/545; Y10T 16/5327; Y10T 16/544; Y10T 16/5448; Y10T 16/5387; Y10T 16/577
USPC ..... 312/405, 326; 16/354, 248, 361, 357, 16/362, 364
See application file for complete search history.

(56) References Cited

U.S. PATENT DOCUMENTS 2,078,815 A 4/1937 Segar
2,626,420 A * 1/1953 Mongin ..... E05F 1/1253 16/79
2,975,013 A 4/1959 Wallace
3,916,481 A * 11/1975 Pittasch ..... E05D 3/022 16/245
4,609,234 A * 9/1986 Naniwa ..... E05D 3/022 16/341
4,727,622 A 3/1988 Tsuneki
4,765,027 A * 8/1988 Andric ..... E05D 3/122 16/354
4,979,265 A * 12/1990 Grass ..... E05D 3/022 16/291
5,040,857 A * 8/1991 Mandel ..... E05D 3/022 16/364
8,226,183 B2 7/2012 Kang
8,267,492 B2 9/2012 Lucas
(Continued)

*Primary Examiner* — Hiwot E Tefera
(74) *Attorney, Agent, or Firm* — Pearne & Gordon LLP

(57) ABSTRACT

A hinge assembly provided for pivotally connecting a door to a main body of a refrigerator. The hinge assembly is configured such that the door is translationally moved with respect to the main body in response to a pivot motion of the door. The hinge assembly comprises a housing having a first slot, a second slot, and a protrusion. A primary gear is attached to the door and slidably positioned within the first slot of the housing such that a pivot motion of the door rotates the primary gear in a first rotational direction. Additionally, a secondary gear, rotationally engaging the primary gear, is slidably positioned within the second slot of the housing. The secondary gear further comprises a cam profile adjacent to the protrusion.

13 Claims, 17 Drawing Sheets

(56) References Cited

U.S. PATENT DOCUMENTS

| | | | | |
|---|---|---|---|---|
| 2009/0241290 | A1* | 10/2009 | Jones | B41J 3/4071 16/291 |
| 2010/0283366 | A1* | 11/2010 | Lucas | E05D 3/022 312/401 |
| 2010/0283367 | A1* | 11/2010 | Coleman | E05D 3/022 312/405 |
| 2012/0117884 | A1 | 5/2012 | Oshima | |

* cited by examiner

ARTICULATING HINGE FOR A REFRIGERATOR

BACKGROUND OF THE INVENTION

Field of the Invention

This application relates generally to a hinge assembly for mounting a door to a main body of a refrigerator, and more specifically, to an articulating hinge assembly that permits translational movement of the door with respect to the main body in response to a pivot motion of the door.

Description of Related Art

Generally, a refrigerator is an electrical appliance that keeps food fresh in a storage compartment for a period of time by maintaining an interior temperature thereof to be lower than an exterior temperature. The storage compartment is defined by a main body of the refrigerator. The refrigerator generates cool air as a refrigerant circulates a cooling cycle and supplies the cool air to the storage compartment to maintain the food in the storage compartment at a predetermined low temperature.

Often, a refrigerator will have multiple storage compartments. For example, a refrigerator may include both a fresh food compartment and a freezer compartment. The fresh food compartment is where food items such as fruits, vegetables, and beverages are stored and the freezer compartment is where food items that are to be kept in a frozen condition are stored. In some cases, the freezer compartment and the fresh food compartment will be vertically aligned, with one compartment above the other. Alternatively, the refrigerator may be designed such that the freezer compartment and the fresh food compartment are aligned side-by-side.

Typically, a door is pivotally installed on the main body using hinges that are connected to a face of the main body and extend forwardly from a side of the main body to which the door opens. One hinge is provided above the door to secure a top portion of the door while another hinge is provided below the door to secure a bottom portion of the door. For refrigerators with multiple compartments that are vertically aligned, a top door may be pivotally installed for the top compartment and a bottom door may be installed for the bottom compartment using the hinges described above. Moreover, a middle hinge may be mounted between the top and bottom doors that secure both the top and bottom doors to the cabinet.

SUMMARY

According to one aspect, the subject application involves a refrigerator comprising a main body that defines an insulated storage chamber. The refrigerator further comprises a door for opening and closing the storage chamber. A hinge assembly is provided for pivotally connecting the door to the main body. The hinge assembly is configured such that the door is translationally moved with respect to the main body in response to a pivot motion of the door. Additionally, the hinge assembly may further comprise a compression spring that biases a primary gear toward a secondary gear.

The hinge assembly comprises a housing having a first slot, a second slot, and a protrusion. The housing may be attached to the main body. The primary gear is attached to the door and slidably positioned within the first slot of the housing such that a pivot motion of the door rotates the primary gear in a first rotational direction. Additionally, the secondary gear, rotationally engaging the primary gear, is slidably positioned within the second slot of the housing. The secondary gear further comprises a cam profile adjacent to the protrusion. The cam profile may be disposed on a top surface of the secondary gear.

Interaction of the protrusion and the cam profile causes the primary and secondary gears to translate along the first and second slots, respectively, which in turn causes said translational movement of the door with respect to the main body. Of note, the rotation of the primary gear rotates the secondary gear in a second rotational direction opposite to the first rotational direction. The rotation of the secondary gear causes the protrusion to engage the cam profile such that the secondary gear slides within the second slot away from the main body.

In another example, the cam profile may comprise a cylindrical portion and a stationary contact portion. When the door is in a closed position, the protrusion is positioned adjacent the stationary contact portion of the cam profile. The stationary contact portion may contact the protrusion. Additionally, the stationary contact portion may have two or more points of contact with the protrusion. When the door pivots over a predetermined angle (e.g., 5° or other angle measured from the closed position), the protrusion engages the cylindrical portion of the cam profile such that the secondary gear slides within the second slot away from the main body. When the secondary gear slides within the second slot, the primary gear slides within the first slot away from the main body. In one example, the secondary gear and the primary gear may slide in a parallel direction. Furthermore, the secondary gear and the primary gear may slide along a common axis.

The above summary presents a simplified summary in order to provide a basic understanding of some aspects of the systems and/or methods discussed herein. This summary is not an extensive overview of the systems and/or methods discussed herein. It is not intended to identify key/critical elements or to delineate the scope of such systems and/or methods. Its sole purpose is to present some concepts in a simplified form as a prelude to the more detailed description that is presented later.

BRIEF DESCRIPTION OF THE DRAWINGS

The invention may take physical form in certain parts and arrangement of parts, embodiments of which will be described in detail in this specification and illustrated in the accompanying drawings which form a part hereof and wherein.

DETAILED DESCRIPTION

Figure 1:
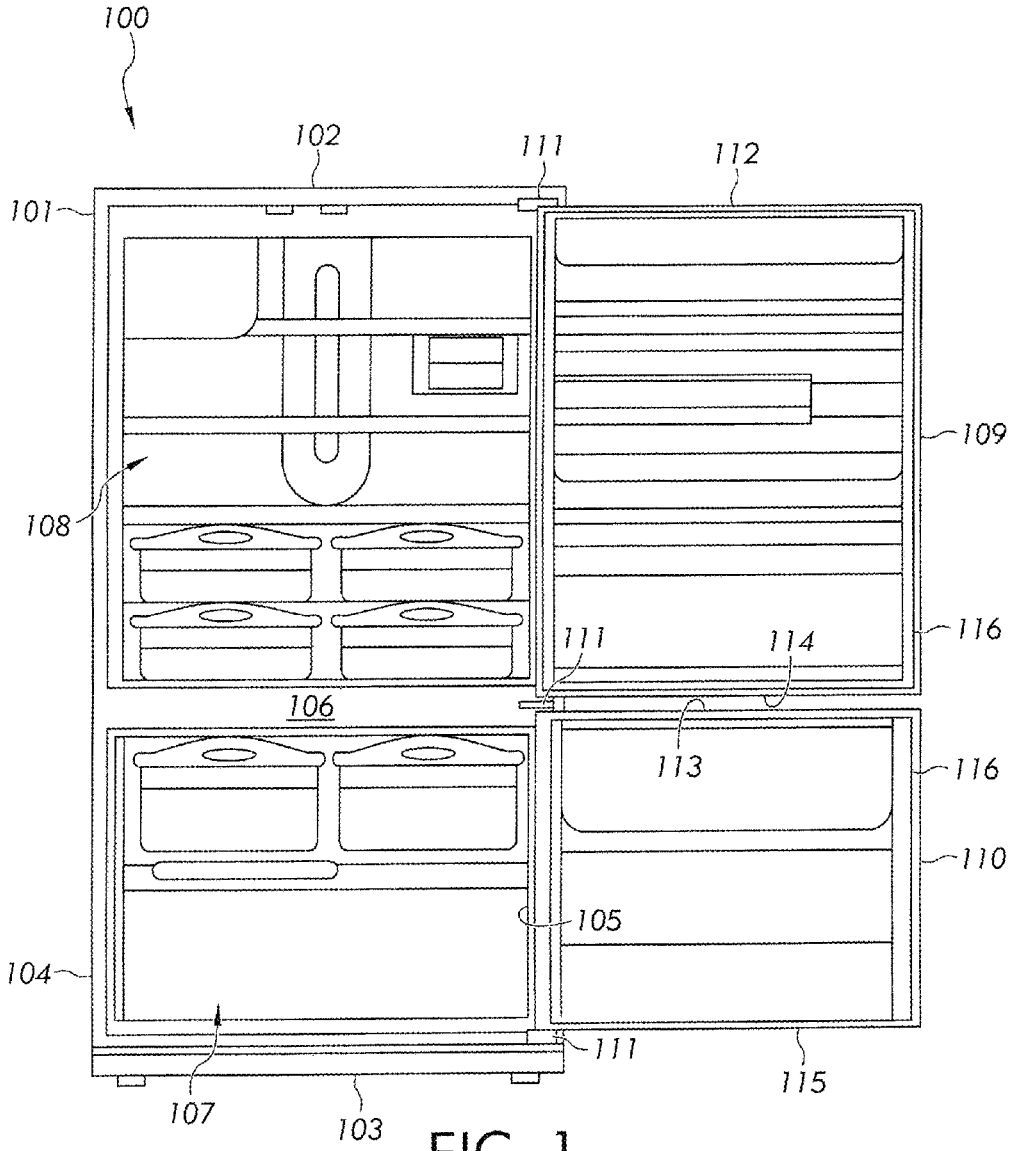
FIG. 1 shows a perspective view of an embodiment of a refrigerator having a fresh food compartment and freezer compartment.

The apparatus will now be described more fully hereinafter with reference to the accompanying drawings in which embodiments of the disclosure are shown. Whenever possible, the same reference numerals are used throughout the drawings to refer to the same or like parts. However, this disclosure may be embodied in many different forms and should not be construed as limited to the embodiments set forth herein. Relative language used herein is best understood with reference to the drawings, in which like numerals are used to identify like or similar items. Further, in the drawings, certain features may be shown in somewhat schematic form.

Referring to FIG. 1, there is illustrated a refrigeration appliance in the form of a domestic refrigerator, indicated generally at 100. The refrigerator 100 comprises a cabinet or main body 101 having a top wall 102, a bottom wall 103, and a pair of opposed side walls 104, 105 extending normally from and between the top wall 102 and bottom wall 103. The main body 101 further comprises a face 106 that is normal to the top wall 102, bottom wall 103, and the pair of opposed side walls 104, 105. A liner is disposed adjacent the inner surfaces of the main body 101, thereby defining an insulated storage chamber that includes a freezer compartment 107 vertically disposed below a fresh-food compartment 108. Furthermore, legs are generally attached to the bottom wall 103 of the main body 101 in order to vertically space the bottom wall 103 from the ground.

Although FIG. 1 shows a main body 101 which includes a freezer compartment 107 vertically disposed below a fresh food compartment 108, the compartments 107, 108 could be reversed or may be side-by-side. Alternatively, the main body 101 may only have a single compartment. The refrigerator 100 can have any desired configuration including a main body and a door without departing from the scope of the invention.

Moreover, doors 109, 110 are provided to provide access to each compartment 107, 108. Each door 109, 110 is pivotally installed on the main body 101 using hinges 111 that are attached to the main body 101 and configured such that each door 109, 110 opens toward a side of the main body 101. The doors 109, 110 are arranged so that top surfaces 112, 113 and bottom surfaces 114, 115 of the doors 109, 110 are substantially parallel to the top wall 102 and bottom wall 103. It is hereby noted that for brevity further discussion will make reference to only the single door 109. However, it is emphasized that the disclosure below applies to any door secured to a main body of a refrigerator by a hinge.

Figure 6A:
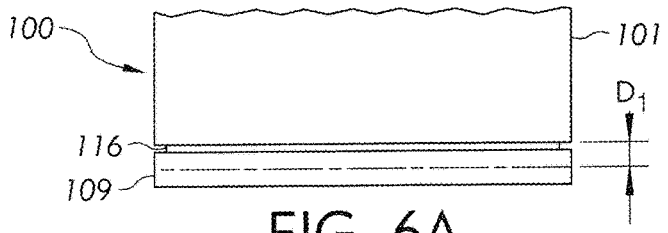
FIG. 6A shows a schematic top view of the refrigerator when the door is in a closed position.

As shown in FIG. 1, a seal gasket 116 may be provided around an interior perimeter of the door 109. However, in other embodiments, the gasket 116 may be placed around the perimeter of the face 106 of the main body 101. Preferably the gasket 116 extends around the entire perimeter of the face 106, although it may only extend partially. The gasket 116 may be a compression gasket; alternatively, other types of gaskets may be used. As shown in FIG. 6A, when the door 109 is in a closed position, the gasket 116 sits flush against the face 106 of the main body 101 and is interposed between the door and the body. Thus, a seal is created between the main body 101 and the door 109 such that there is no fluid communication between the interior of the refrigerated compartment and the ambient exterior environment, whereby the cool air supplied within the main body 101 will not be affected by exterior air, which generally has a higher temperature.

Traditionally, a portion of the gasket 116 closest to the rotational axis of the door 109 has a tendency to deform relative to the remainder of the gasket 116. Specifically, during a closing operation, as the door 109 approaches the closed position, the portion of the gasket 116 closest to door's rotational axis makes initial contact with the face 106 of the main body 101 and continues to be in contact with the face 106 while the 109 door rotates to the closed position. As such, the portion of the gasket 116 closest to the door's rotational axis rubs or shears against the face 106 of the main body 101. This shearing effect also occurs during an opening operation. As the door 109 is initially opened, the portion of the gasket 116 farthest from the door's rotational axis disconnects from the face 106 of the main body 101 first while the portion of the gasket 116 closest to the door's rotational axis remains in contact with the face 106. As the door 109 continues to rotate, the portion of the gasket 116 closest to the door's rotational axis continues to contact the face 106 of the main body 101 until the door 109 rotates passed some angle. Over time, this repetitive shearing effect causes the gasket 116 to deform, thereby decreasing the functionality of the gasket 116.

Figure 2A:
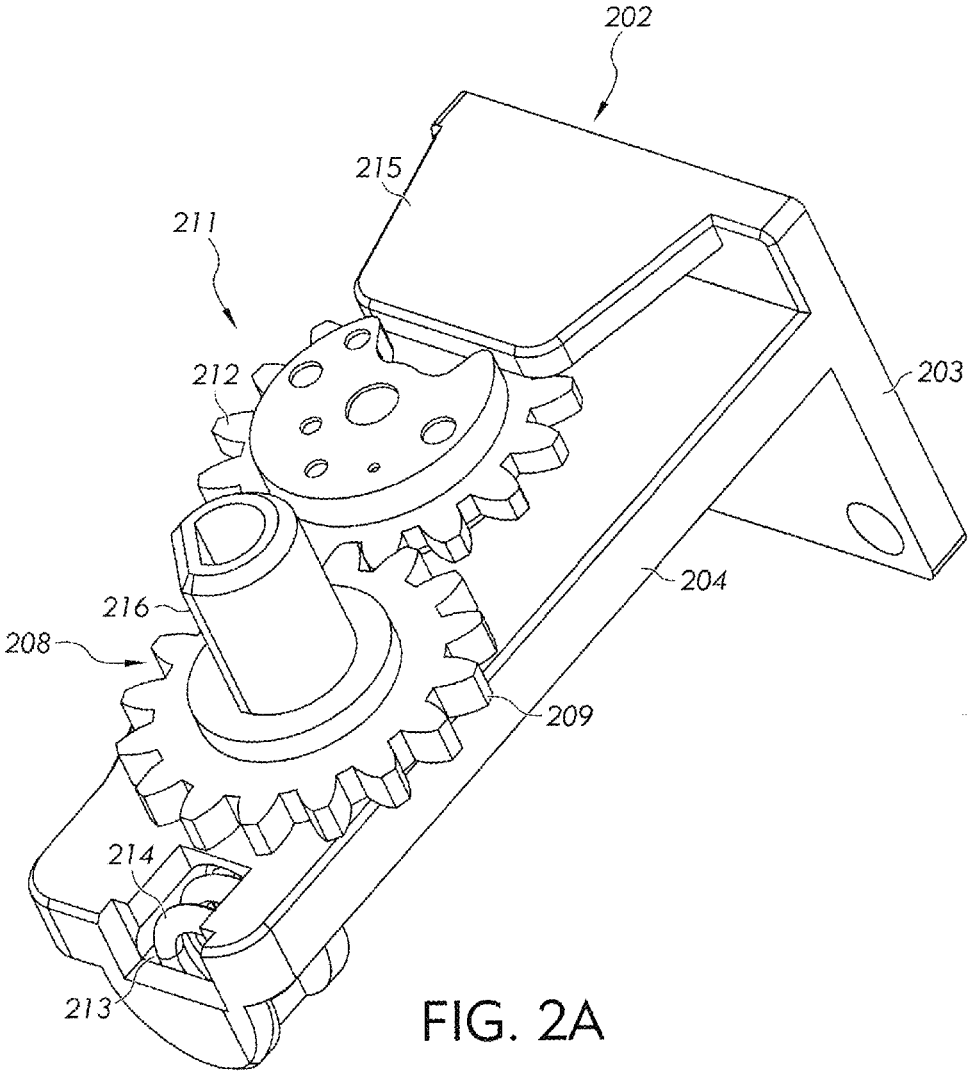
FIG. 2A shows a perspective view of a configuration for a hinge assembly.
Figure 2B:
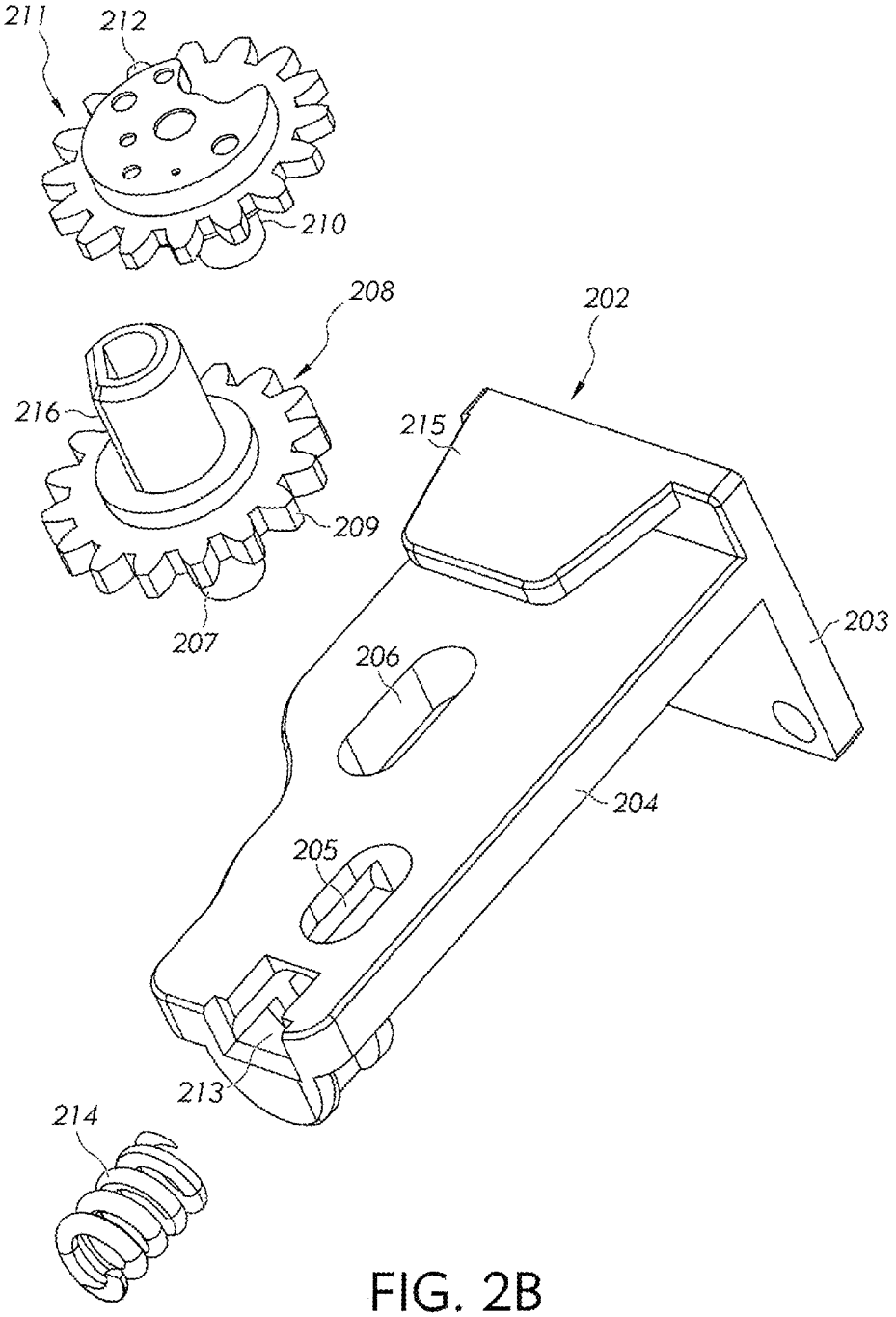
FIG. 2B shows an exploded view of the configuration for the hinge assembly.

FIGS. 2A-2B show a perspective view and an exploded view, respectively, of a hinge assembly configured to pivotally connect the door 109 to the main body 101. The hinge assembly is configured such that it pivotally connects the door 109 to the main body 101 and further translationally moves the door 109 with respect to the main body 101 in response to a pivot motion of the door 109. Such translational movement of the door 109 provides the technical advantage of reducing and/or eliminating the shearing effect on the gasket 116 caused by the interaction between an inner most portion of the gasket (i.e., the portion of the gasket 116 closest to the door's rotational axis) and the face 106 of the main body 101 during opening and/or closing operations.

The hinge assembly comprises a housing 202 that is attachable to the main body 101. The hinge assembly may replace any or all of the hinges 111 shown in FIG. 1. For instance, a fixing portion 203 of the housing 202 may be attached to the face 106 of the main body 101. Alternatively, the housing 202 may be attached to an outer surface of the main body 101. The housing 202 may be attached to the main body 101 by general forms of attachment currently know in the art (e.g., screws, bolts, adhesives or any other fastening means) via suitable holes in the fixing portion 203.

As shown in FIG. 2B, the housing 202 has an elongated portion 204 that is perpendicular to and extends horizontally away from the fixing portion 203. As such, the hinge assembly will stand proud and extend outwards from the main body 101 of the refrigerator 100. The housing 202 further includes a protrusion 215 that extends outwards from the fixing portion 203 at a vertically spaced distance from the elongated portion 204. The elongated portion 204 of the housing 202 has a first slot 205 and a second slot 206. As depicted, the first and second slots 205, 206 may be aligned in a parallel direction. Preferably, the first and second slots 205, 206 are aligned in the same direction that the door 109 will translationally move with respect to the main body 101. Furthermore, the first and second slots 205, 206 may reside on a common axis. Alternatively, the first and second slots 205, 206 may be laterally displaced from one another. As shown, the first and second slots 205, 206 may be apertures which extend completely through the elongated portion 204. Alternatively, the first and second slots 205, 206 may extend only partially into the elongated portion 204.

The first slot 205 is configured to accept a pin 207 of a primary gear 208 such that the primary gear 208 is slidably positioned therein. The primary gear 208 further includes teeth 209 and a pivot shaft 216 configured to be secured to the door 109 such that a pivot motion of the door 109 rotates the primary gear 208 in a first rotational direction. Preferably the pivot shaft 216 has a keyed geometry that interfaces with a corresponding keyed receiver on the door so that rotation of the door causes rotation of the primary gear 208. The second slot 206 is configured to accept a pin 210 of a secondary gear 211 such that the secondary gear 211 is slidably positioned therein. The secondary gear 211 further includes teeth 212 configured to interact with the teeth 209 of the primary gear 208 such that the secondary gear 211 is rotationally engaged with the primary gear 208.

The housing 202 may further include a spring holder 213 configured to house a spring 214 therein. The spring 214 may be of any type (e.g., compression, conical, leaf, etc.) capable of exerting an outward biasing force. As shown, the spring 214 is a compression spring that may be in abutment with, or even attached, at one end, to the primary gear 208. For example, the spring 214 may be in abutment with the pin 207, or alternatively in abutment with an intermediate member (not shown) that is connected to or in abutment with the pin 207. The other end of the spring 214 is in abutment with or attached to an end face of the spring holder 213. The spring 214 is positioned within the spring holder 213 such that it biases the primary gear 208 toward the secondary gear 211. In other words, the spring 214 forces the primary and secondary gears 208, 211 to remain in rotational engagement at all times. Optionally, the gear teeth 212 are disposed underneath the protrusion 215, which can vertically restrain the secondary gear 211.

Figure 3:
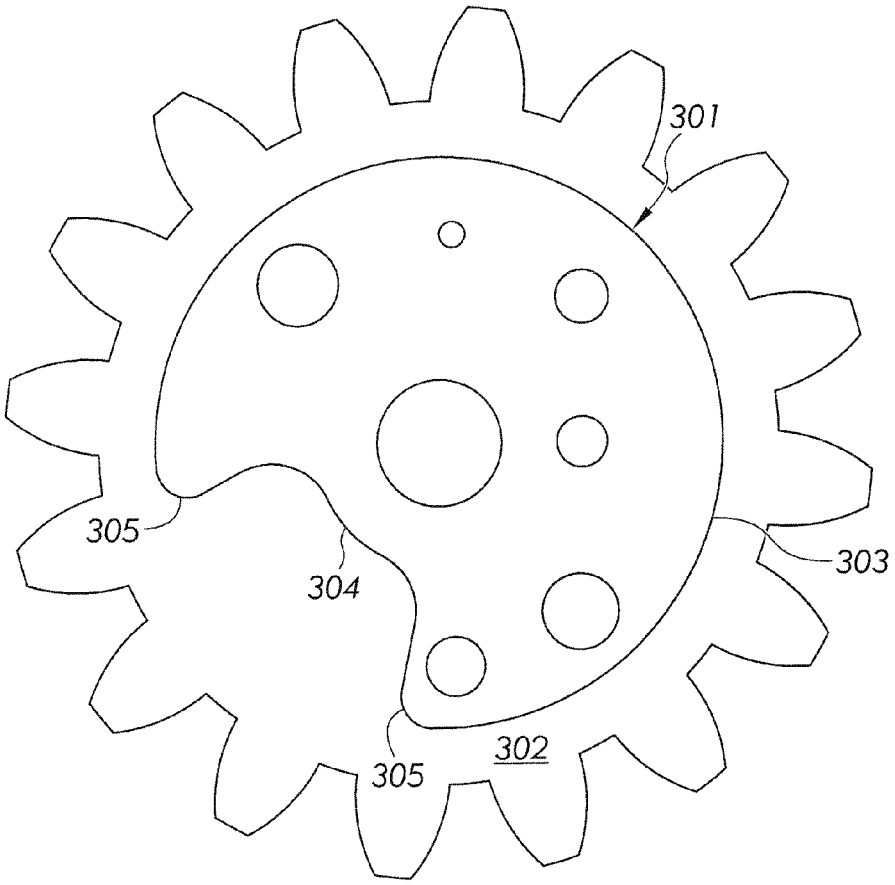
FIG. 3 shows a top view of a secondary gear within the hinge assembly.

FIG. 3 depicts an example embodiment of the secondary gear 211 that permits the door 109 to translationally move with respect to the main body 101 in response to a pivot motion of the door 109. As shown, the secondary gear 211 comprises a cam profile 301. The cam profile 301 may be positioned on a top surface 302 of the secondary gear 211. Furthermore, the cam profile 301 comprises a cylindrical portion 303 and a stationary contact portion 305. As shown, the stationary contact portion 305 has two points of contact that are spaced apart by a recessed portion 304. It is to be understood that the cam profile 301 is not limited to the design as shown in FIG. 3. Other cam profile designs may be used that would likewise permit translational movement.

Figure 4:
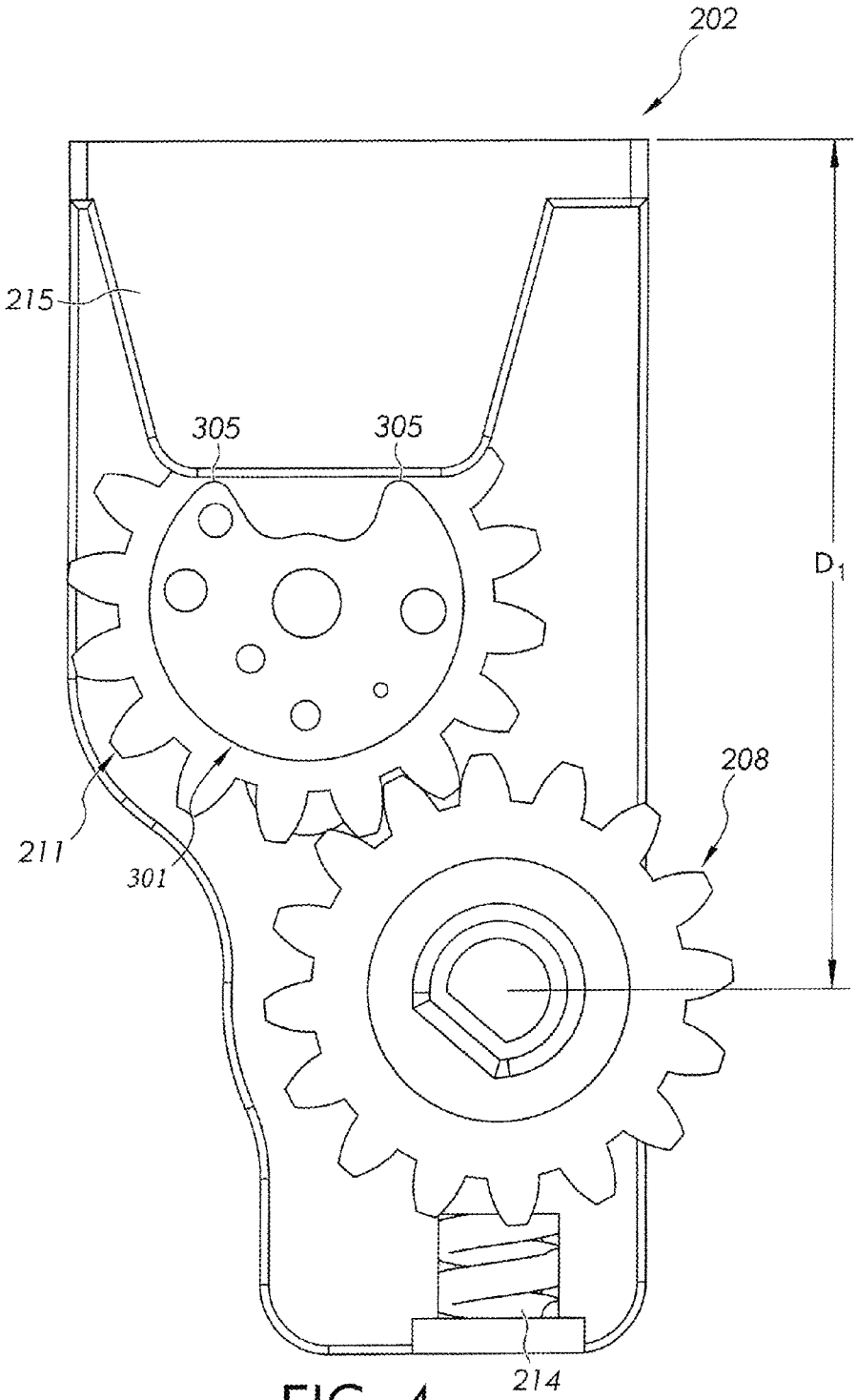
FIG. 4 shows a top view of the hinge assembly when the door is in a closed position.

FIG. 4 depicts a top view of the hinge assembly when the door 109 is in a closed position (as represented in FIG. 6A). As shown, the spring 214 pushes the primary gear 208 toward the secondary gear 211 such that the stationary contact portion 305 of the cam profile 301 is positioned adjacent to an end face of the protrusion 215. The protrusion 215 may be in direct contact with the stationary contact portion 305 of the cam profile 301 such that the stationary contact portion 305 has two points of contact with the protrusion 215. As schematically illustrated in FIG. 6A, when the door 109 is in the closed position and the gasket 116 is seated between the door and the cabinet, the face 106 of the main body 101 is spaced from the rotational axis of the door 109 at a distance of D1. Turning back to FIG. 4, it is noted that the same distance (i.e., D1) spans between a center point of the primary gear 208 and a rear side of the fixing portion 203 of the housing 202.

Figure 5:
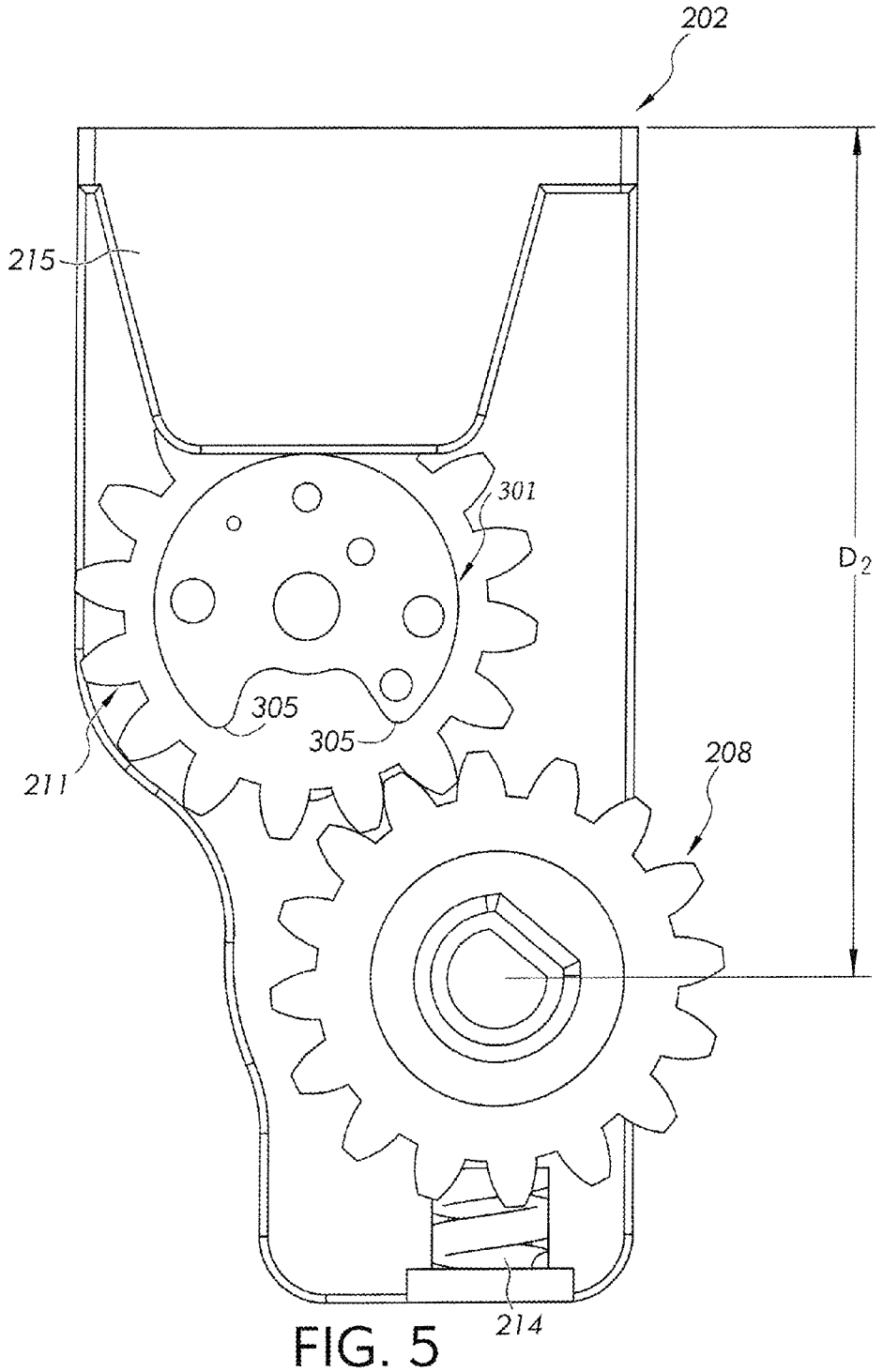
FIG. 5 shows a top view of the hinge assembly when the door pivots to a predetermined angle with respect to the closed position.

FIG. 5 depicts a top view of the hinge assembly when the door 109 is in an opened position. In operation, when a user opens the door 109, the door 109 pivots thereby causing the primary gear 208 to rotate in the first rotational direction. Because the primary gear 208 and the secondary gear 211 are in constant rotational engagement, the rotation of the primary gear 208 thereby rotates the secondary gear 211 in a second rotational direction opposite to the first rotational direction. As the secondary 211 gear rotates in the second rotational direction, the cam profile 301 rotates.

When the door reaches a predetermined angle $\alpha$ (i.e., 5°-20° measured from the closed position, preferably 5°-15°, more preferably 10°-15°), the cam profile 301 rotates such that the contact portion 305 is no longer adjacent to the protrusion 215. Rather, the protrusion 215 engages the cylindrical portion 303 of the cam profile 301. Due to the specific configuration of the cylindrical portion 303 of the cam profile 301, whereby the radius of the cylindrical portion 303 is relatively greater than a radius of a line tangent to the contact portions 305, the engagement between the protrusion 215 and the cylindrical portion 303 causes the secondary gear 211 to slide within the second slot 206 away from the main body 101 of the refrigerator 100. As the secondary gear 211 slides within the second slot 206, the secondary gear 211 applies the same translational motion to the primary gear 208, thus pushing the primary gear 208 away from the main body 101 within the first slot 205 against the force of the spring 214. The center point of the primary gear 208 translationally moves away from the rear side of the fixing portion 203 of the housing 202 such that a distance D2 spans therebetween.

Figure 6B:
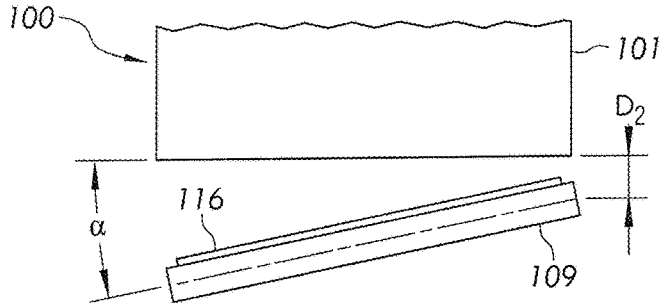
FIG. 6B shows a schematic top view of the refrigerator when the door pivots to the predetermined angle with respect to the closed position.

Because the primary gear 208 and the door 109 are directly connected, as the primary gear 208 moves away from the main body 101, so too does the door 109. As schematically shown in FIG. 6B, when the door 109 pivots to the predetermined angle α sufficient to rotate the contact portions 305 out of contact with the protrusion 215, the door translationally moves away from the main body 101 of the refrigerator 100 at a distance of D2. Of note, the distance D2 (i.e., the distance reached after the door pivots to the predetermined angle α) between the center point of the primary gear 208 and the main body 101 is a greater distance than that of D1 (i.e., the distance when the door is in the closed position). Thus, when the door 109 pivots to the predetermined angle α, the door 109 translationally moves away from the main body 101 thereby providing additional space between the main body 101 and the gasket 116. This additional space ultimately reduces and/or eliminates any shearing effect on the gasket 116 caused by the interaction between an inner most portion of the gasket (i.e., the portion of the gasket 116 closest to the door's rotational axis) and the face 106 of the main body 101 during opening and/or closing operations. Preferably, the translation motion of the door causes substantially all, or the entire, gasket 116 to be spaced at least the distance D2.

Figure 6C:
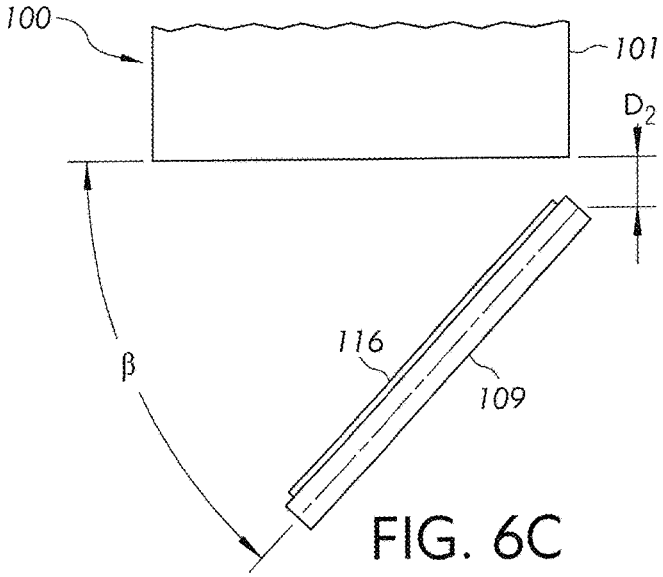
FIG. 6C shows a schematic top view of the refrigerator when the door pivots to an angle greater than the predetermined angle, with respect to the closed position.

As schematically shown in FIG. 6C, as the door 109 pivots to an angle β that is greater than the predetermined angle α, the constant radius cylindrical portion 303 continues to engage the protrusion 215 such that the primary and secondary gears 208, 211 do not further translate within the first and second slots 205, 206, respectively, and a rotational axis of the primary gear 208 remains stationary such that the door 109 pivots without further translational motion. Simply put, as the door 109 pivots to any angle greater than the predetermined angle α (i.e., angle β), the distance between the main body 101 and rotational axis of the door 109 remains the same (i.e., D2).

The hinge assembly also provides the same technical advantage during a closing operation. When a user intends to close the door 109, the user provides a force to the door 109 such that it begins to pivot toward the closed position. As the door 109 pivots, the cylindrical portion 303 of the cam profile 301 is engaged with the protrusion 215. When the door 109 reaches the predetermined angle α, the protrusion 215 no longer engages the cylindrical portion 303, but rather is positioned adjacent the stationary contact portion 305 of the cam profile 301. The transition from the protrusion 215 engaging the cylindrical portion 303 to being adjacent the stationary contact portion 305 causes the primary and secondary gears 208, 211 to transitionally move within the first and second slots 205, 206, respectively, toward the main body 101 by the outward biasing force of the spring 314. Thus, the distance between the central point of the primary gear 208 and the rear side of the fixing portion 203 of the housing 202 reverts to D1.

Referring now to FIGS. 7-10, according to another aspect, there is provided an anti-tip leveling leg for a domestic appliance. The embodiments discussed herein relate to an anti-tip leveling leg for reducing and/or eliminating the potential for the domestic appliance to tip over or have a leaning orientation. The embodiments are discussed in the context of a domestic appliance (e.g., refrigerator, freezer, oven, dishwasher, etc.). In particular, the embodiments are discussed in the context of the refrigerator appliance 101 as depicted in FIG. 1.

Figure 7A:
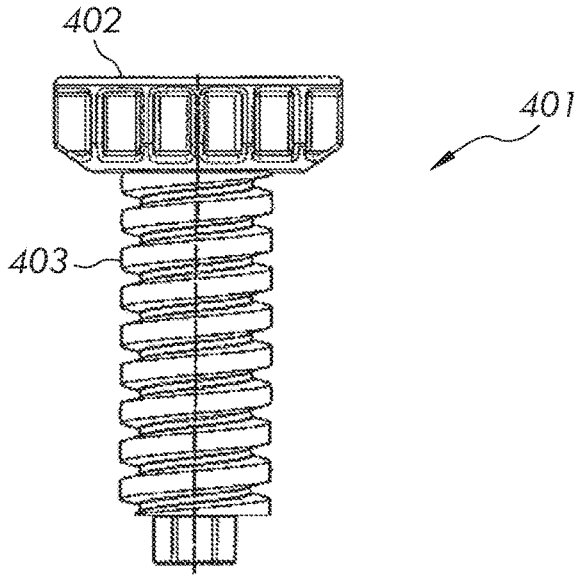
FIG. 7A shows a side view of an anti-tip leveling leg used to stabilize the refrigerator.
Figure 7B:
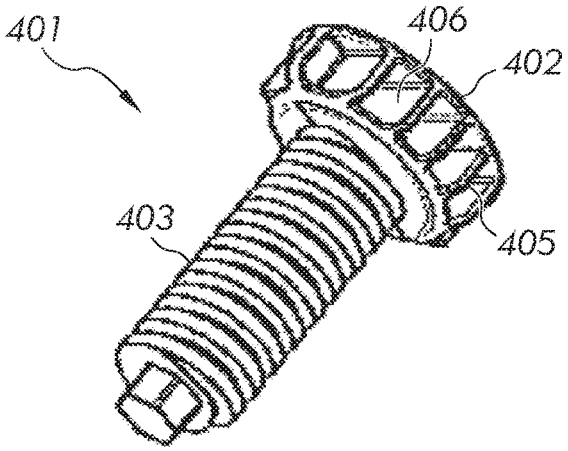
FIG. 7B shows a perspective view of the anti-tip leveling leg used to stabilize the refrigerator.

FIGS. 7A and 7B show an example embodiment of an anti-tip leveling leg 401 having a head portion 402 and a stem portion 403. The anti-tip leveling leg 401 may be a monolithic body (i.e., the head portion 402 is integral with the stem portion 403), comprising a single material (e.g., 33% glass filled nylon). Alternatively, the head portion 402 and stem portion 403 may be individually constructed and then subsequently attached to form the anti-tip leveling leg 401.

The head portion 402, as shown, is cylindrically shaped and has an outer diameter of 38.1 millimeters (i.e., approximately 1.5 inches). The head portion 402 may alternatively be designed to have a different shape (e.g., square, triangular, polygonal, etc.) and/or size. Furthermore, the head portion 402 has a plurality of ribs 405 formed on an outer periphery thereof. The space between each rib 405 defines a pocket 406 configured to accept the head of a tool. The stem portion 403 extends from, and perpendicular to, the head portion 402 and has a thread formed on its outer periphery. The thread may cover the entire length of the stem portion 403, or may only cover a portion of the stem portion 403.

Figure 8:
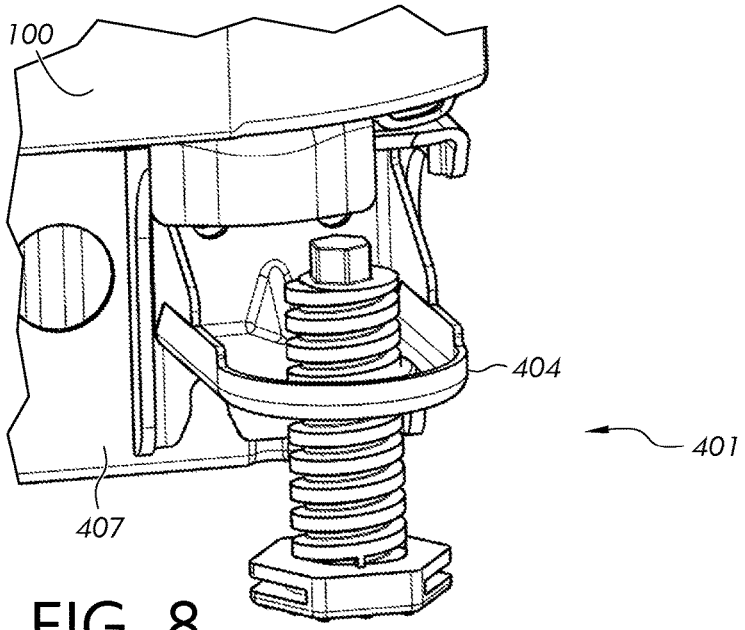
FIG. 8 shows a perspective view of the anti-tip leveling leg stabilizing the refrigerator.

In operation, as shown in FIG. 8, the stem portion 403 of the anti-tip leveling leg 401 is inserted into a bracket 404 at a bottom of the refrigerator having a generally L-shaped construction and attached to a toe grille 407 of the refrigerator appliance 100 by at least one fastener. To properly install the anti-tip leveling leg 401, a user places a tool (e.g., a flat head screw driver) into a pocket 406 of the head portion 402 and turns the anti-tip leveling leg 401. Alternatively, the top of the anti-tip leveling leg 401 can have a hex head for a wrench. Due to the thread, as the anti-tip leveling leg 401 turns, the head portion 402 moves vertically relative to the bracket 404, thus stabilizing the bottom wall 103 of the refrigerator 100.

Figure 9:
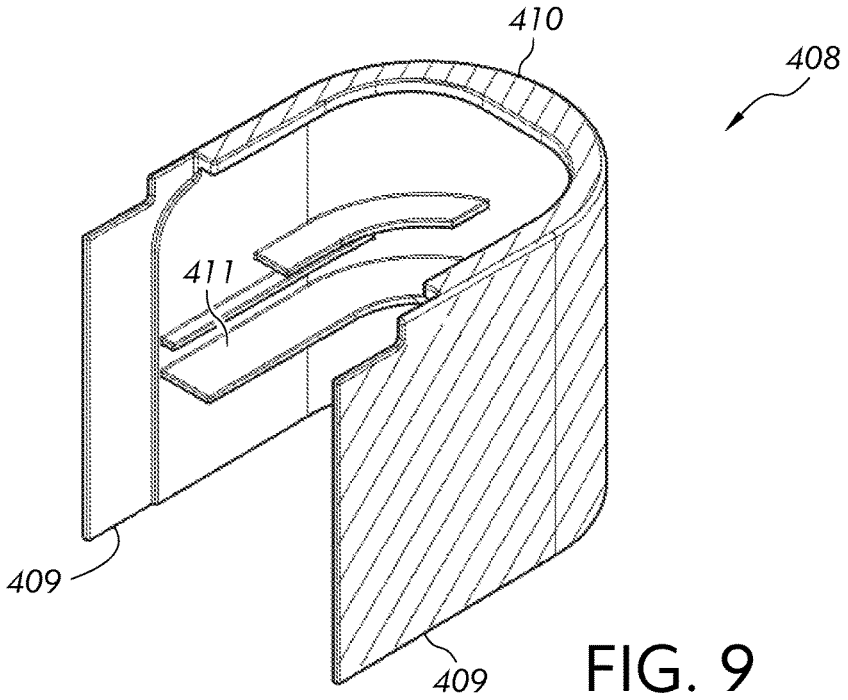
FIG. 9 shows a perspective view of a cover configured to conceal the anti-tip leveling leg.
Figure 10:
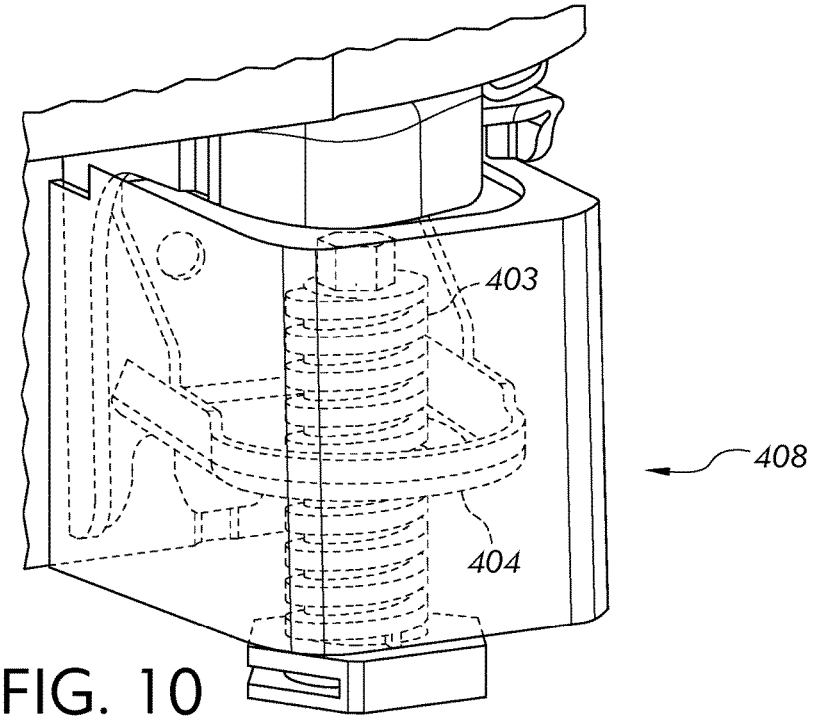
FIG. 10 shows a perspective view of the cover concealing the anti-tip leveling leg.

As shown in FIGS. 9 and 10, a cover 408 is disposed around the anti-tip leveling leg 401 thereby concealing and protecting it. The cover 408 is generally U-shaped having parallel legs 409 connected by a central curved portion 410. The cover 408 includes opened top and bottom portions and is of sufficient height to conceal both the anti-tip leveling leg 401 and the bracket 404. An inner surface of the cover 408 is provided with an elastic snap feature 411 configured to interact with the bracket 404 so as to connect the cover 408 thereto. Specifically, the snap feature 411 engages a lip of the bracket 404 thereby securing it thereto. The cover 408 is configured such that it can be attached to and removed from the bracket 404 without the use of a tool.

Figure 11:
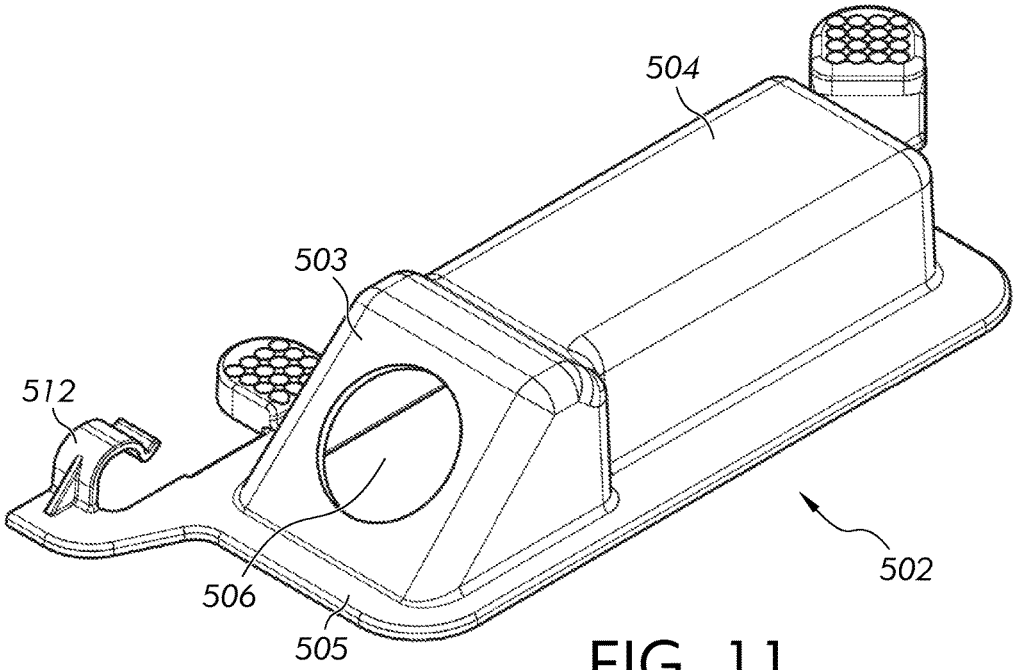
FIG. 11 shows a perspective view of a control box connector housing.
Figure 12:
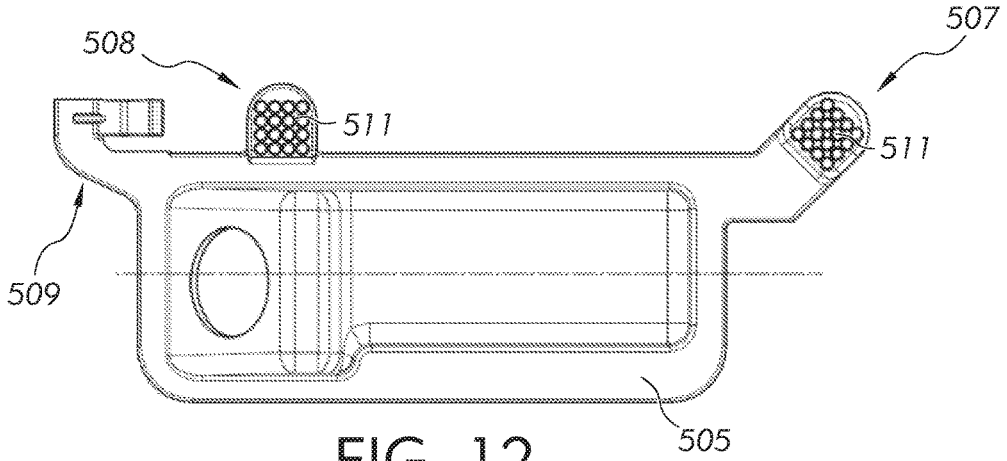
FIG. 12 shows a top view of the control box connector housing.
Figure 13:
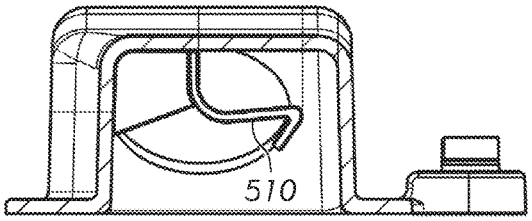
FIG. 13 shows a cross-sectional view of the control box connector housing.

Referring now to FIGS. 11-13, according to yet another aspect, there is provided a control box connector housing 502 configured to attach to an exterior surface of a refrigerator liner and further provided for securing and guiding electrical wires to a combination lighting and temperature control box (discussed infra). The connector housing 502 is an injection molded housing having a first structure 503 and a second structure 504 that together define a hollow area wherein the bottoms of said first and second structures 503, 504 are open. The first structure 503 has a generally triangular cross-section whereas the second structure 504 is generally rectangular in shape. As shown, the first structure 503 is generally wider than the second structure 504. Furthermore, a flange 505 extends around the outer periphery of both the first and second structures 503, 504.

The connector housing 502 further includes an access hole 506 located on a side of the first structure 503. Specifically, the access hole 506 is positioned on a slanted wall of the first structure 503. However, in other embodiments, the access hole may be placed on other surfaces of either the first structure 503 or second structure 504. Furthermore, additional apertures may be positioned on any surface of the first and second structures 503, 504. The access hole 506 allows electrical wires to be inserted into the hollow area of the connector housing 502.

As shown in FIG. 12, the connector housing 502 additionally includes at least one protrusion extending outward from the flange 505 in the horizontal direction. Specifically, a first protrusion 507 extends from a corner of the flange 505. The first protrusion 507 has an elbow shape, wherein a slanted portion extends in a direction away from a lateral center line of the connector housing 502. Alternatively, the first protrusion 507 may have a slanted portion extending in a direction towards the lateral center line of the connector housing 502. A second protrusion 508 extends from, and perpendicular to, a central portion of the flange 505.

Both the first and second protrusions 507, 508 have anchor portions 511 configured to secure the connector housing 502 to the liner by accepting a screw therein. The anchor portions 511 include multiple circular openings, preferably in an array or pattern, that extend at least partially therethrough. The diameter of the circular openings may be smaller than the diameter of the screw to be inserted therein. The depth of the anchoring portions 511 is sufficient to provide proper fastener holding force, while its overall width is sufficient to provide a large target area.

A third protrusion 509 extends outward from another corner of the flange 505. The third protrusion 509 also has a general elbow shape that extends in a direction away from a lateral center line of the connector housing 502. Furthermore, a cable management hook 512 is positioned on the third protrusion 509. The cable management hook 512 extends vertically from the third protrusion 509 and is configured to secure and help guide the electrical wires into the access hole 506.

In operation, an adhesive (e.g., double-sided tape, glue, etc.) is applied to a face of the flange 505 in order to secure the connector housing 502 to the liner. An aperture will be provided on a top-rear portion of the refrigerator liner that is coincident with the major opening into the connector housing 502. The connector housing 502 is positioned and secured on an exterior surface of the refrigerator liner such that the hollow area is positioned adjacent the aperture. Electrical wires are then secured by the cable management hook 512 and inserted through the access hole 506 and into the hollow area. As shown in FIG. 13, a securing hook 510 extends from a ceiling of the second structure 504 and secures the electrical wires within the connector housing during a foaming process. Alternatively, the securing hook may extend from a ceiling of the first structure 503.

Figure 14:
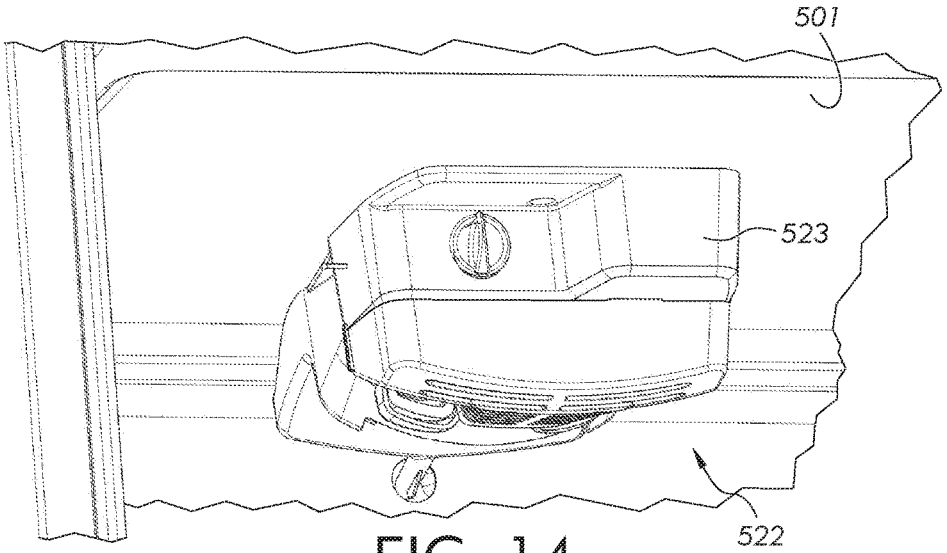
FIG. 14 shows a perspective view of a control box secured to a liner of the refrigerator.
Figure 15:
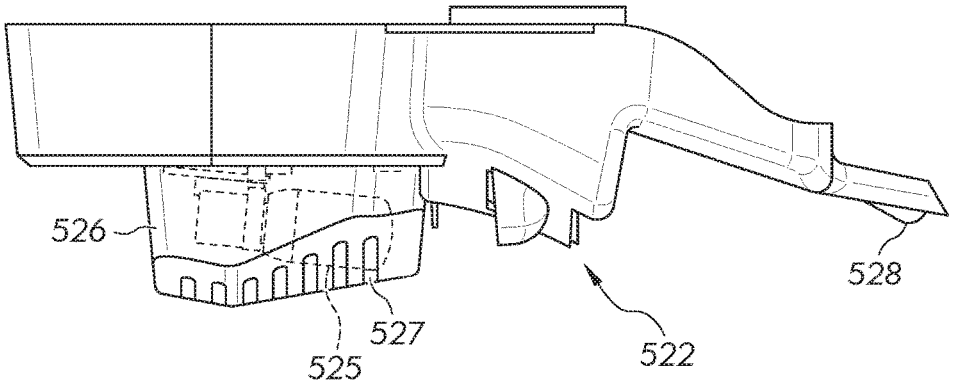
FIG. 15 shows a side view of the control box.

Referring now to FIGS. 14-15, a combination lighting and temperature control box 522 is shown mounted on a top-rear portion of a refrigerator liner 501. Specifically, the control box 522 is positioned and secured on an interior surface of the top-rear portion of the liner 501. The control box 522 is located beneath an aperture in the liner 501 such that the control box 522 is in spatial communication with the hollow area of the connector housing 502 (discussed supra).

A housing 523 of the control box 522 is secured to the liner 501 by fastening means (e.g., screws, clips, pins, etc.). In general, conventional control boxes employed within refrigerators are designed to have a long profile (e.g., extending the length from the front of the refrigerator to the rear). As shown, the control box 522 has a "short" design in that it extends less than the full depth of the fresh-food compartment, such as about half. In one embodiment, the housing 523 of the control box 522 measures approximately 12 inches in depth and 6.5 inches in width. Furthermore, the housing 523 may be designed to include an offset in its front, approximately 1 inch.

The housing 523 is injection molded and encompasses a cold control assembly that provides temperature control of the fresh food compartment. Additionally the housing 523 may encompass an air diffuser 528 formed at the rear of the control box 522. The air diffuser 528 is configured to mate with a cold-air vent that guides cold air into the refrigerator compartment. Still further, the housing 523 may encompass a terminal block which enables checking the function of a defrost heater and a timer.

As shown in FIG. 15, the control box 522 includes an LED bulb 525 that is surrounded by a lens cover 526. The lens cover 526 may include apertures 527 therein to help prevent the LED bulb and/or the housing 523 from over-heating. Furthermore, a heat shield may be used to protect the housing 523 from over-heating.

Figure 16A:
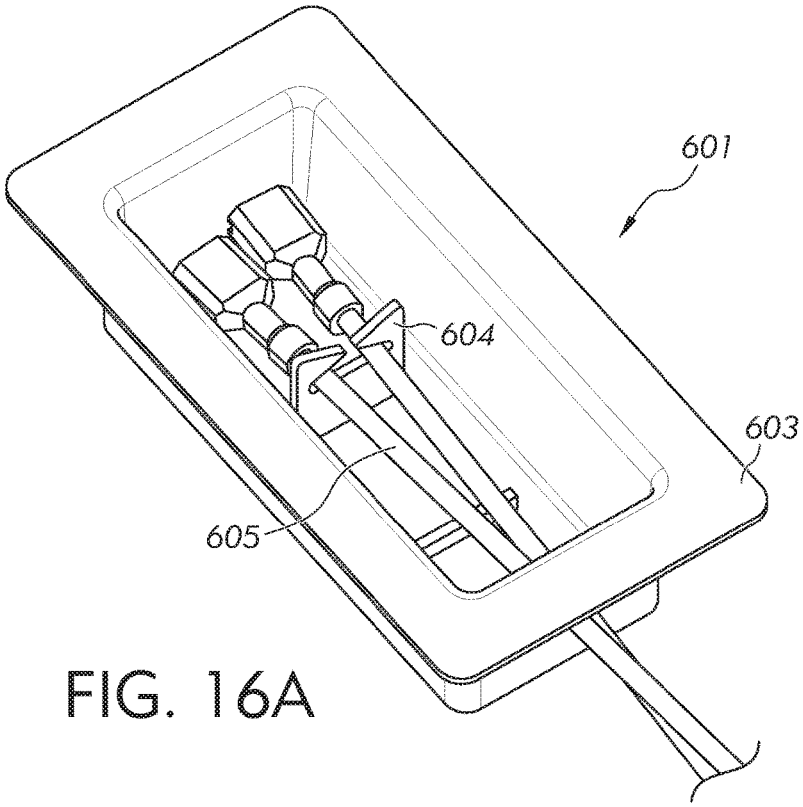
FIG. 16A shows a perspective view of a control switch housing.

Moreover, conventional control boxes having a long profile often include a spring-loaded electrical switch that is physically turned on/off when a door of the refrigerator is opened or closed. When the refrigerator door is opened, the door switch is triggered to turn on an interior light within the refrigerator. The "short" control box 522 is spaced from the door at a distance that would not allow the door to interact with the switch. Thus, as shown in FIG. 16A, the refrigerator 100 may include a door switch housing 601 located adjacent an exterior wall of the liner 501 and mounted separately from the control box 522.

As shown, the switch housing 601 is an injection molded housing that includes a front wall, rear wall, and side walls. The switch housing 601 further includes an outer flange portion 603 configured to abut an exterior surface of the liner 501. Additionally, at least one aperture is located in a wall of the switch housing 601 and configured to allow electrical wires 605 to pass therethrough. The electrical wires 605 are secured within the switch housing 601 by a clamping feature 604. The clamping feature 604 extends from, and perpendicular to, a bottom surface of the switch housing 601, and includes slots configured to retain electrical wires 605 therein. In other embodiments, the clamping feature 604 may include different shapes and/or designs, so long as the clamping feature 604 maintains its function of securing and retaining electrical wires 605 therein.

Figure 16B:
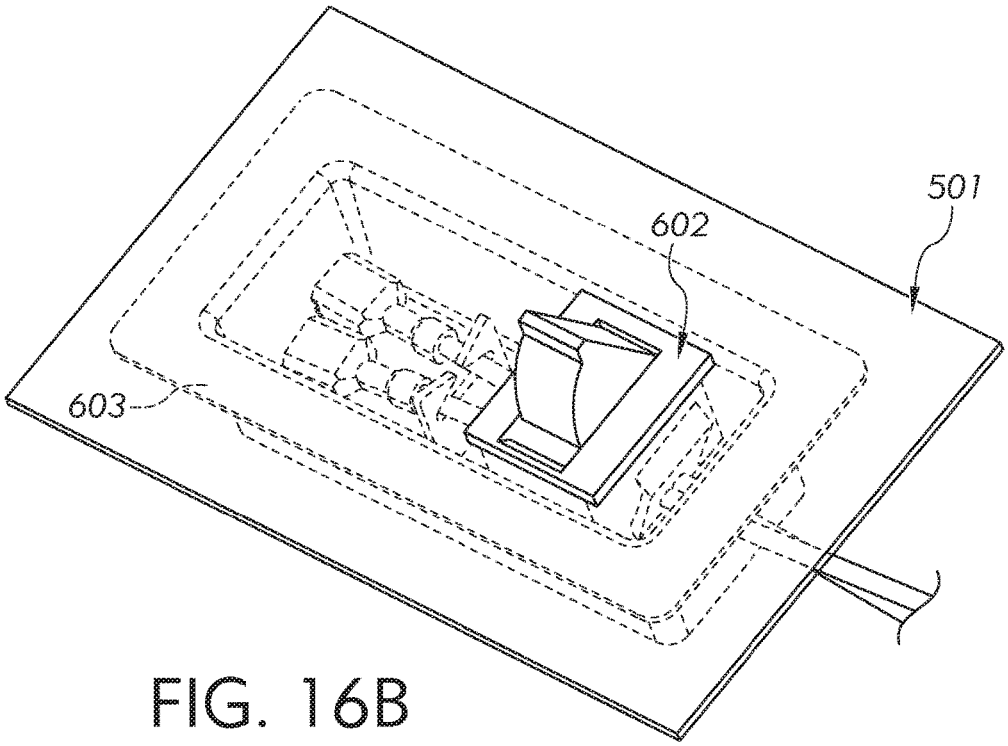
FIG. 16B shows a perspective view of the control switch housing attached to a liner of the refrigerator.

In operation, as shown in FIG. 16B, the switch housing 601 is secured to the exterior surface of the liner 501 by an adhesive (e.g., double-sided tape). The switch housing 601 is secured to the liner 501 at a position wherein it surrounds a pre-cut open hole that is configured to accept a spring-loaded electrical switch 602 therein. As such, the clamping feature 604 suspends the electrical wires 605 within the switch housing 601 in a way that provides easy access to the electrical wires 605 during installation. After the spring-loaded electrical switch 602 is electrically connected to the electrical wires 605, the spring-loaded electrical switch is positioned within the pre-cut open hole in the liner 501.

In order to improve lead time and overall efficiency within a refrigerator manufacturing facility, it is beneficial to make a universal liner employed within multiple models of refrigerators. For example, it is beneficial to provide a universal liner with the pre-cut open hole, as discussed above. As such, if the specific model of refrigerator being manufactured utilizes the "short" control box 522, the liner will already include the pre-cut open hole therein, and no extra processing and/or machine set-up will be required. Alternatively, if the refrigerator being manufactured includes the "long" control box, then said control box will have a spring-loaded electrical switch incorporated therein, thus there would be no need for a separately mounted switch housing.

Figure 17:
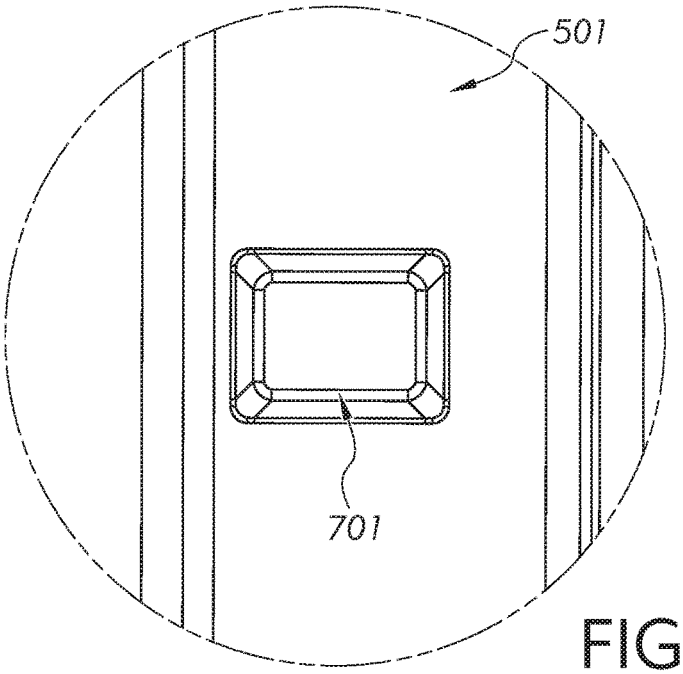
FIG. 17 shows a perspective view of a cover plate attached to a liner of the refrigerator.
Figure 18:
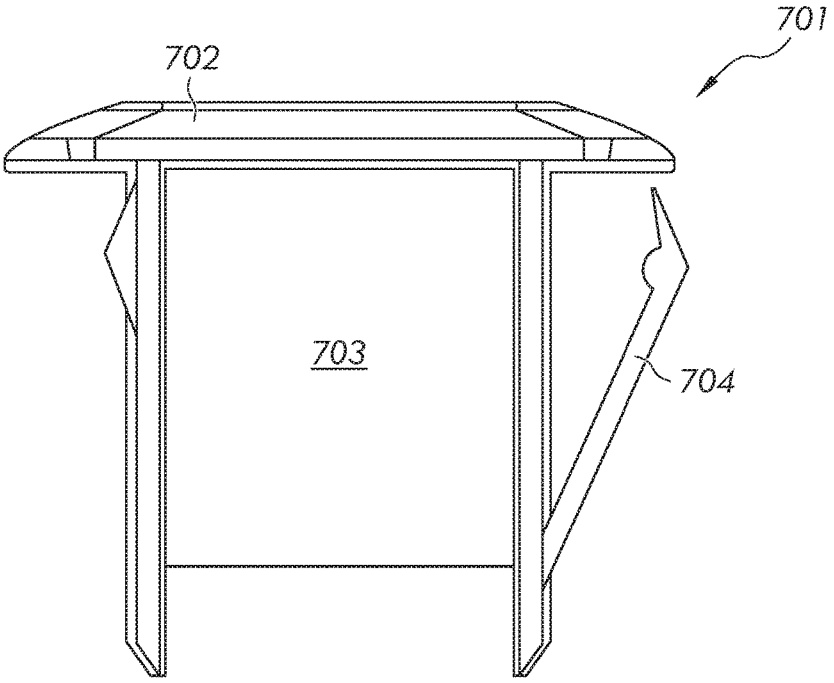
FIG. 18 shows a side view of the cover plate.
Figure 19:
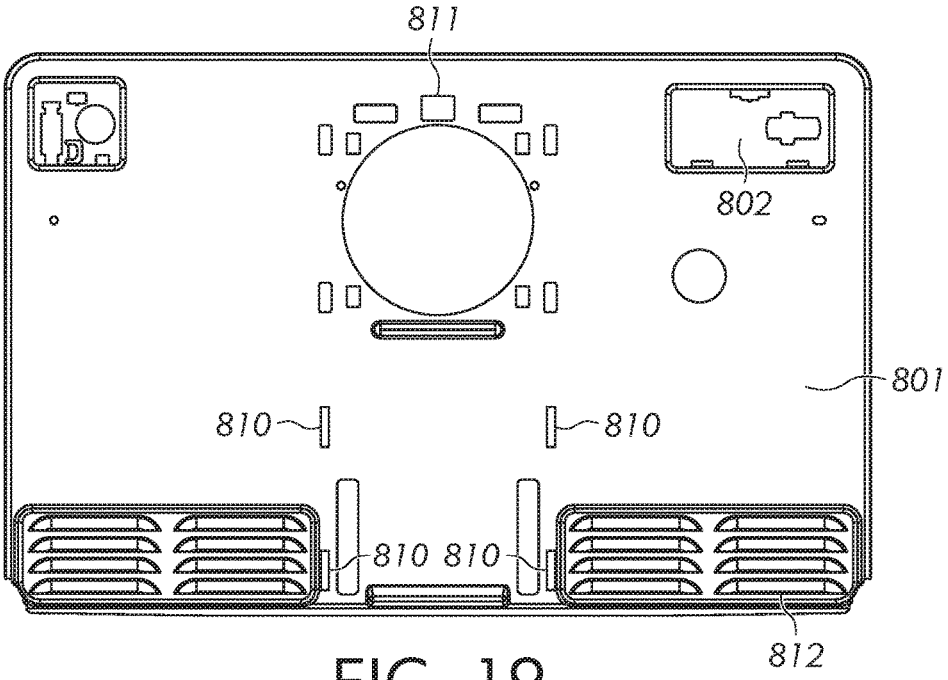
FIG. 19 shows a frontal view of a cooling system cover.

In such an instance, the pre-cut open hole would not be used to secure a spring-loaded electrical switch therein. Thus, as shown in FIG. 17, an injection molded cover plate 701 can be positioned adjacent an inside surface of the liner 501, and snapped into place within the pre-cut open hole of the liner 501. As depicted in FIG. 18, the cover plate 701 includes a rectangular face 702 from which an insert body 703 extends therefrom. The insert body 703 includes protrusions 704 configured to provide a secure connection into the liner 501 when pressure is applied perpendicular to the face 702 of the cover plate 701, whereby the liner is clamped between the flange of the cover plate 701 and the protrusions 704. The face 702 of the cover plate 701 may have a design different than a rectangle (e.g., circular, triangular, etc.). Furthermore, the cover plate 701 may include fastening means other than the protrusions 704 located on the insert body 703 (e.g., adhesives, tab and slot configurations, etc.).

Referring now to FIGS. 19-23, according to a further aspect, there is provided a cooling system cover 801 configured to be mounted adjacent an evaporator in a refrigerator compartment (i.e., either a fresh-food compartment and/or a freezer compartment). As shown, the cooling system cover 801 includes return vents 812 for drawing in air after said air has circulated within the refrigerator compartment. The return vents 812 are located at a lower portion of the cooling system cover 801.

Figure 20:
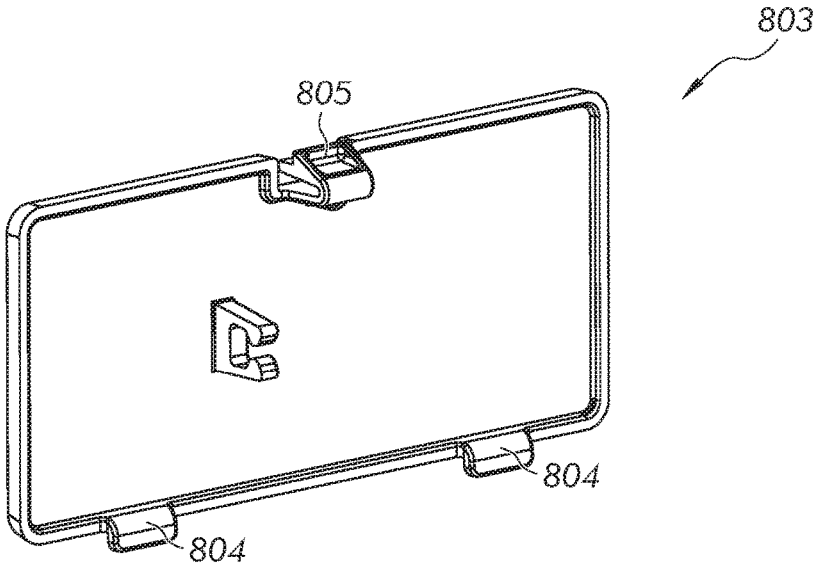
FIG. 20 shows a perspective view of a access opening cover configured to be removably secured to the cooling system cover.

The cooling system cover 801 further includes an access opening 802 provided at an upper corner thereof and configured to permit an aftermarket addition of a light within the refrigerator compartment. Generally, the access opening 802 is covered by an access opening cover 803, as shown in FIG. 20. The access opening cover 803 includes tabs 804 and a snap feature 805 configured to interact with slots within the access opening 802 in order to secure the access opening cover 803 thereto. The refrigerator compartment has the light wiring and harness pre-installed behind the access opening 802; thus, the light socket will initially be covered by the access opening cover 803.

Figure 21:
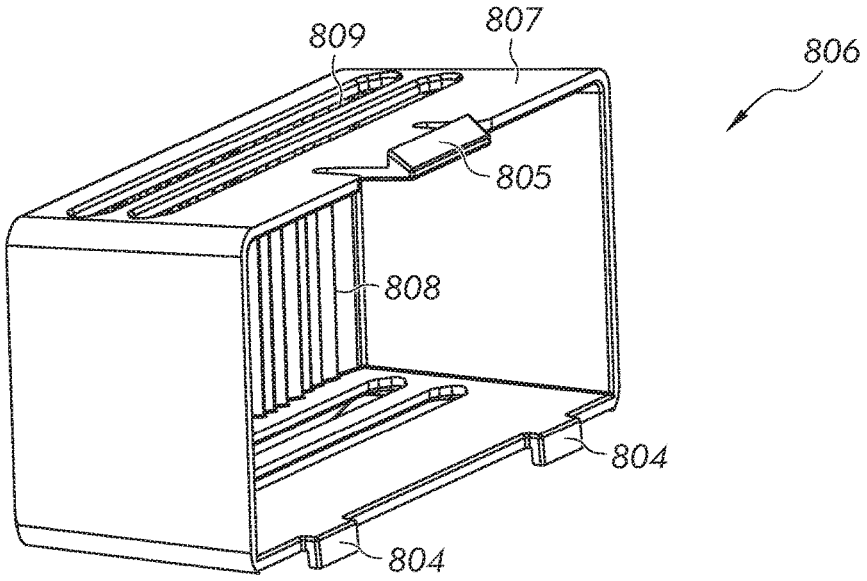
FIG. 21 shows a perspective view of a light lens configured to be removably secured to the cooling system cover.

In the event that a user desires to add an aftermarket light within the refrigerator compartment, the access opening cover 803 can be removed from the cooling system cover 801 such that a light source (e.g., light bulb, LED, etc.) can be installed within the access opening 802. After installation of the light source, a transparent light lens 806, as shown in FIG. 21, can be installed over the access opening 802. The light lens 806 includes a body having front, rear, and side walls that all extend from a bottom surface. The light lens 806 is injection molded and comprised of polycarbonate material.

The light lens 806 further includes angled surfaces 808, positioned on the bottom surface, configured to refract light across the internal area of the refrigerator compartment. Still further, the light lens 806 includes vent holes 809 on at least one wall of the body 807 that provide ventilation for the light source, thus preventing over-heating of the light source. In order to secure the light lens 806 to the cooling system cover 801, the light lens 806 includes the same, or similar, tabs 804 and snap feature 805 used to secure the access opening cover 803 to the cooling system cover 801. Thereby, no additional modifications are needed to secure the light lens 806 to the cooling system cover 801.

Moving back to the cooling system cover 801, a plurality of slots 810 may be positioned in a central portion thereof for attaching a fan cover 901 thereto. Furthermore, the cooling system cover 801 includes an expanded hole 811 at a top portion thereof to ensure screw clearance between the fan cover 901 and a bracket used to attach the fan cover 901 to the cooling system cover 801.

Figure 22:
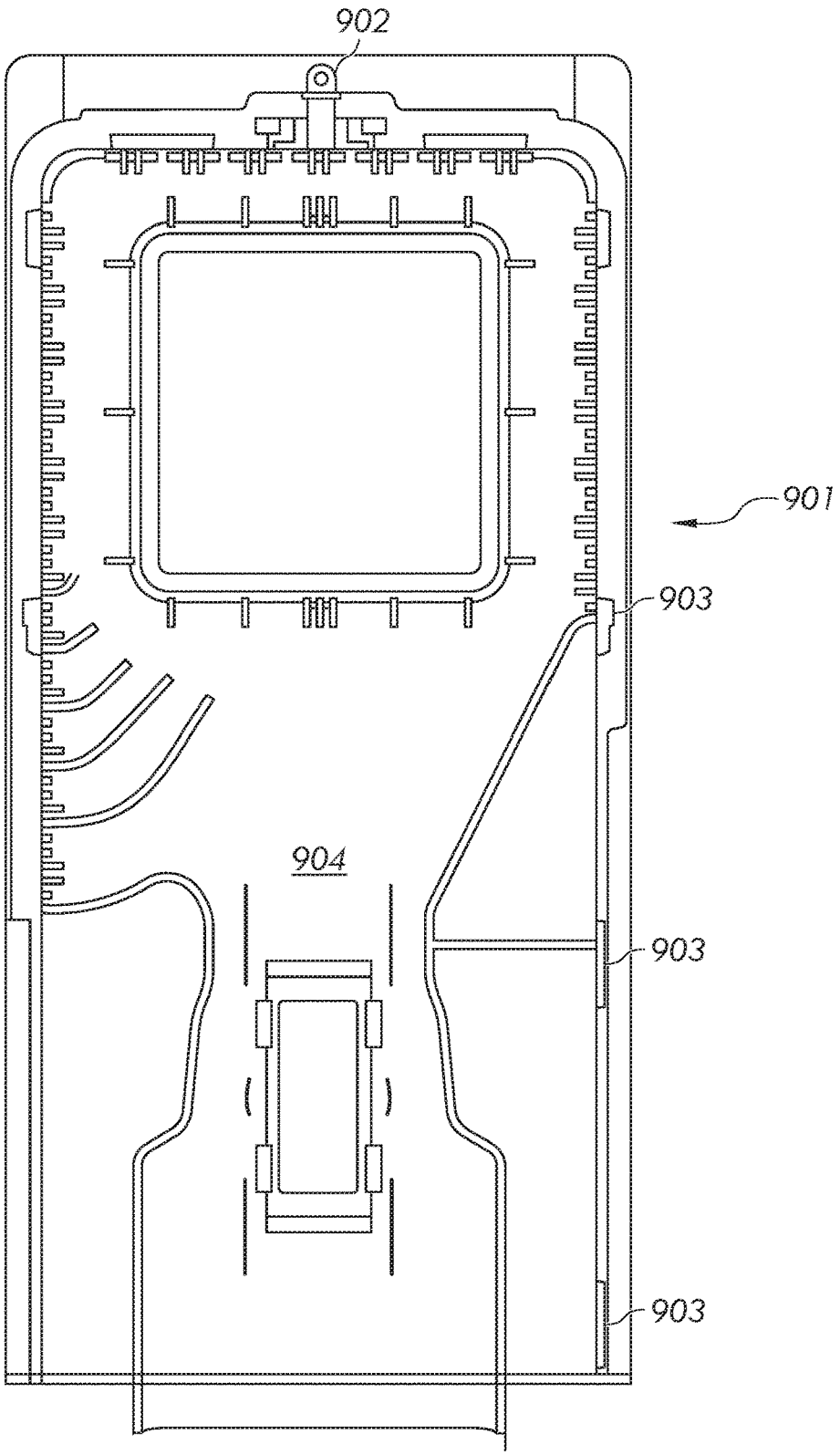
FIG. 22 shows a view of a rear side of a fan cover configured to be secured to the cooling system cover.

As shown in FIG. 22, the fan cover 901 is a substantially flat, elongated cover that attaches to an outward facing portion (i.e., towards the refrigerator compartment) of the cooling system cover 801. The fan cover 901 includes a boss 902 at a top portion thereof to allow for a better seal between the fan cover 901 and the cooling system cover 801. In a further embodiment, a second boss (not shown) may be positioned at a bottom portion of the fan cover 901.

The fan cover 901 further includes outwardly extending hooks 903 in registry with and configured to be inserted within the corresponding slots 810 on the cooling system cover 801 in order to secure the fan cover 901 thereto. In other embodiments, the fan cover 901 may be secured to the cooling system cover 801 by fastening means other than a hook and slot configuration (e.g., screws, adhesives, clamps, etc.).

The fan cover 901 is configured to direct air to the refrigerator compartment (i.e., the fresh-food compartment and/or the freezer compartment). The fan cover 901 includes protrusions that extend orthogonally between the fan cover 901 and the cooling system cover 801 such that, when the fan cover 901 is attached thereto, the protrusions outline a flow path for air therebetween.

Figure 23:
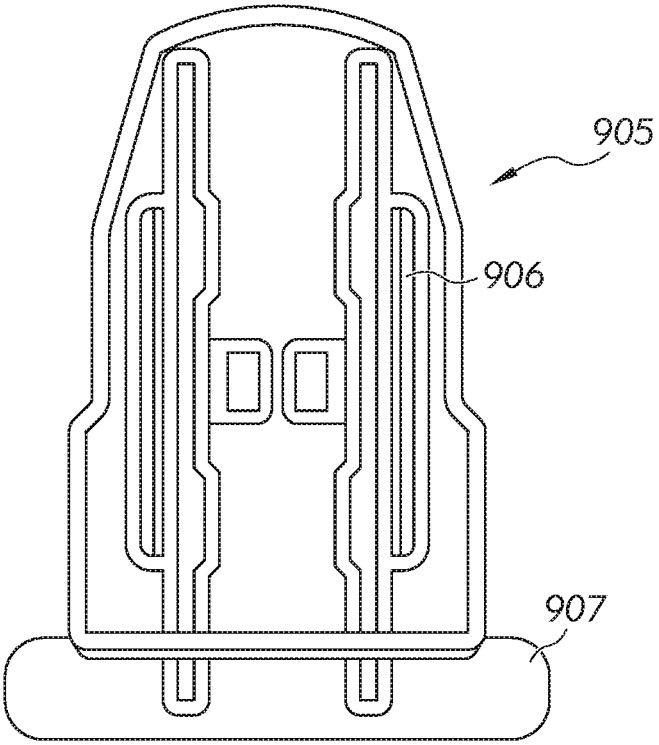
FIG. 23 shows a frontal view of a damper configured to be secured to the fan cover.

In order to control the amount of air going into the refrigerator compartment, a damper 905, as shown in FIG. 23, may be attached to a damper receiving area 904 located on a rearward facing portion (i.e., facing the cooling system cover 801, when installed) of the fan cover 901. The damper 905 is located in a narrow passageway formed between the protrusions. The damper 905 comprises a polygonal shape wherein a lower portion thereof is wider than an upper portion thereof. The damper 905 further includes a plurality of detents 906 (e.g., seven detents) to allow a user to adjust temperature control within the refrigerator compartment. Still further, an enlarged assembly protrusion 907 located on the bottom portion of the damper 905 prevents the damper 905 from being installed in the wrong direction.

Figure 24:
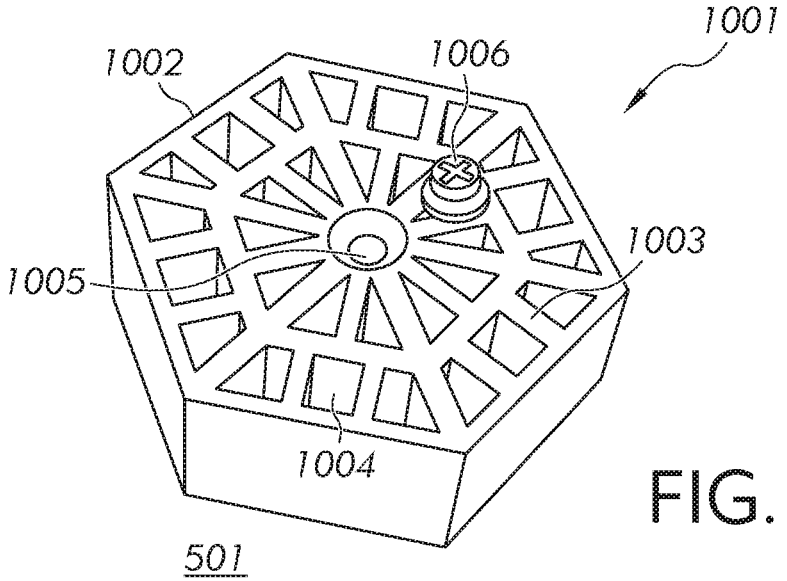
FIG. 24 shows a perspective view of a plastic anchor.

Referring now to FIG. 24, according to yet another aspect, there is provided a hidden plastic anchor 1001 configured to mount items to the liner 501 within the refrigerator. More specifically, the plastic anchor 1001 is an injection molded anchor for mounting an appliance feature or accessory (e.g., cooling system cover 801, control box 522, ice maker assemblies, under mullion deli brackets, etc.) to the liner 501 using a screw 1006. The plastic anchor 1001 provides a large "target" area to ensure that the screw 1006 is secured during manufacturing, as well as a relatively large load bearing surface area to spread out the weight of the supported item(s).

As shown, the plastic anchor 1001 comprises a polygonal shape having a hexagonal outer ring 1002. A central defined aperture 1005 has six rods that extend entirely to the corners of the hexagonal outer ring 1002. A plurality of intersecting walls 1003 are connected to, and formed between, the six rods. The space created between the intersecting walls 1003 define inner apertures 1004, preferably in an array or pattern, that extend through the plastic anchor 1001. As shown, the inner apertures 1004 have neither a uniform shape nor size. However, in alternative embodiments, the inner apertures 1004 may be designed to have uniform shapes and/or sizes. Furthermore, the plastic anchor 1001, as shown, includes 31 total apertures. In alternative embodiments, the total number of apertures may be greater than or less than 31.

In another contemplated embodiment, the plastic anchor 1001 has a 1 inch width with the inner apertures 1004 being smaller in size than the diameter of the screw 1006 to be inserted therein. Additionally, the plastic anchor 1001 includes a depth of approximately ⅜ of an inch to allow for sufficient interaction between the screw 1006 and the plastic anchor 1001 to provide adequate support for the appliance feature or accessory being installed.

In operation, the plastic anchor 1001 is temporarily secured to an exterior surface of the liner 501 by an adhesive (e.g., double-sided tape, glue, etc.). Thereafter, a screw 1006 is driven blindly from the interior side of the refrigerator liner 501 into the plastic anchor 1001. The inner apertures 1004 receive and secure the screw 1006 therein. Although the aforementioned design of the plastic anchor 1001 was described as having a hexagonal shape, it is understood that the plastic anchor 1001 may take a different shape (e.g., rectangular, circular, triangular, etc.).

It should be apparent that the foregoing relates only to certain embodiments of the present application and that numerous changes and modifications may be made herein by one of ordinary skill in the art without departing from the general spirit and scope of the invention as defined by the following claims and equivalents thereof.

What is claimed is:

1. A refrigerator comprising:

a main body defining an insulated storage chamber;

a door opening and closing the storage chamber; and a hinge assembly pivotally connecting the door to the main body and translationally moving the door with respect to the main body in response to a pivot motion of the door, the hinge assembly comprising:

a housing having a first slot, a second slot, and a protrusion;

a primary gear attached to the door and slidably positioned within the first slot of the housing wherein the pivot motion of the door rotates the primary gear in a first rotational direction; and a secondary gear rotationally engaging the primary gear and slidably positioned within the second slot of the housing, wherein the secondary gear further comprises a cam profile adjacent to the protrusion, wherein interaction of the protrusion and the cam profile causes the primary and secondary gears to translate along the first and second slots, respectively, which in turn causes said translational movement of the door with respect to the main body.

2. The refrigerator of claim 1, wherein the hinge assembly further comprises a compression spring that biases the primary gear toward the secondary gear.

3. The refrigerator of claim 1, wherein the housing is attached to the main body.

4. The refrigerator of claim 1, wherein the cam profile is disposed on a top surface of the secondary gear.

5. The refrigerator of claim 1, wherein the cam profile comprises a cylindrical portion and a recessed portion.

6. The refrigerator of claim 5, wherein when the door is in a closed position, the protrusion is positioned adjacent the recessed portion of the cam profile.

7. The refrigerator of claim 5, wherein when the door pivots over a predetermined angle, the protrusion engages the cylindrical portion of the cam profile such that the secondary gear slides within the second slot away from the main body.

8. The refrigerator of claim 7, wherein when the secondary gear slides within the second slot, the primary gear slides within the first slot away from the main body.

9. The refrigerator of claim 8, wherein the secondary gear and the primary gear slide in a parallel direction.

10. The refrigerator of claim 8, wherein the secondary gear and the primary gear slide along a common axis.

11. The refrigerator of claim 7, wherein the predetermined angle is within the range of 5°-20° measured from the closed position.

12. The refrigerator of claim 1, wherein the rotation of the primary gear rotates the secondary gear in a second rotational direction opposite to the first rotational direction.

13. The refrigerator of claim 12, wherein the rotation of the secondary gear causes the protrusion to engage the cam profile such that the secondary gear slides within the second slot away from the main body.

* * * * *